United States Patent [19]

Dann

[11] 4,045,631

[45] Aug. 30, 1977

[54] TOUCH-SENSITIVE DOOR CONTROL SWITCH

[75] Inventor: Daryl L. Dann, Owosso, Mich.

[73] Assignee: Midland-Ross Corporation, Cleveland, Ohio

[21] Appl. No.: 672,871

[22] Filed: Apr. 2, 1976

[51] Int. Cl.[2] ..... H01H 3/16; E05F 15/00

[52] U.S. Cl. ..... 200/61.43

[58] Field of Search ..... 200/61.43, 85 A, 86 R, 200/161; 49/26–28

[56] References Cited

U.S. PATENT DOCUMENTS

| | | | |
|---|---|---|---|
| 1,576,950 | 3/1926 | Conklin | 200/61.43 |
| 2,048,514 | 7/1936 | Peelle | 200/61.43 |
| 2,135,131 | 11/1938 | Bassett | 200/61.43 |
| 2,437,969 | 3/1948 | Paul | 200/86 R |
| 2,493,157 | 1/1950 | Merralls et al. | 200/161 X |
| 3,670,119 | 6/1972 | Gebhardt et al. | 200/85 A X |

*Primary Examiner*—James R. Scott
*Attorney, Agent, or Firm*—Woodrow W. Portz

[57] ABSTRACT

Disclosed is a touch-sensitive apparatus adapted for mounting on the edges of mass transit vehicle doors. The apparatus provides an elongate flexible housing of which a proximal end portion is rigidly supported by a door edge, and a distal end portion may warp in response to manual pressure to operate a switch and switch actuating assembly enclosed within a longitudinal passageway of the distal portion which controls an electrical circuit for door-opening mechanism. The assembly includes a switch supported in one end of the passageway and a taut cable or other flexible member supported lengthwise of the passageway centrally through spaced support blocks.

8 Claims, 6 Drawing Figures

FIG. 1
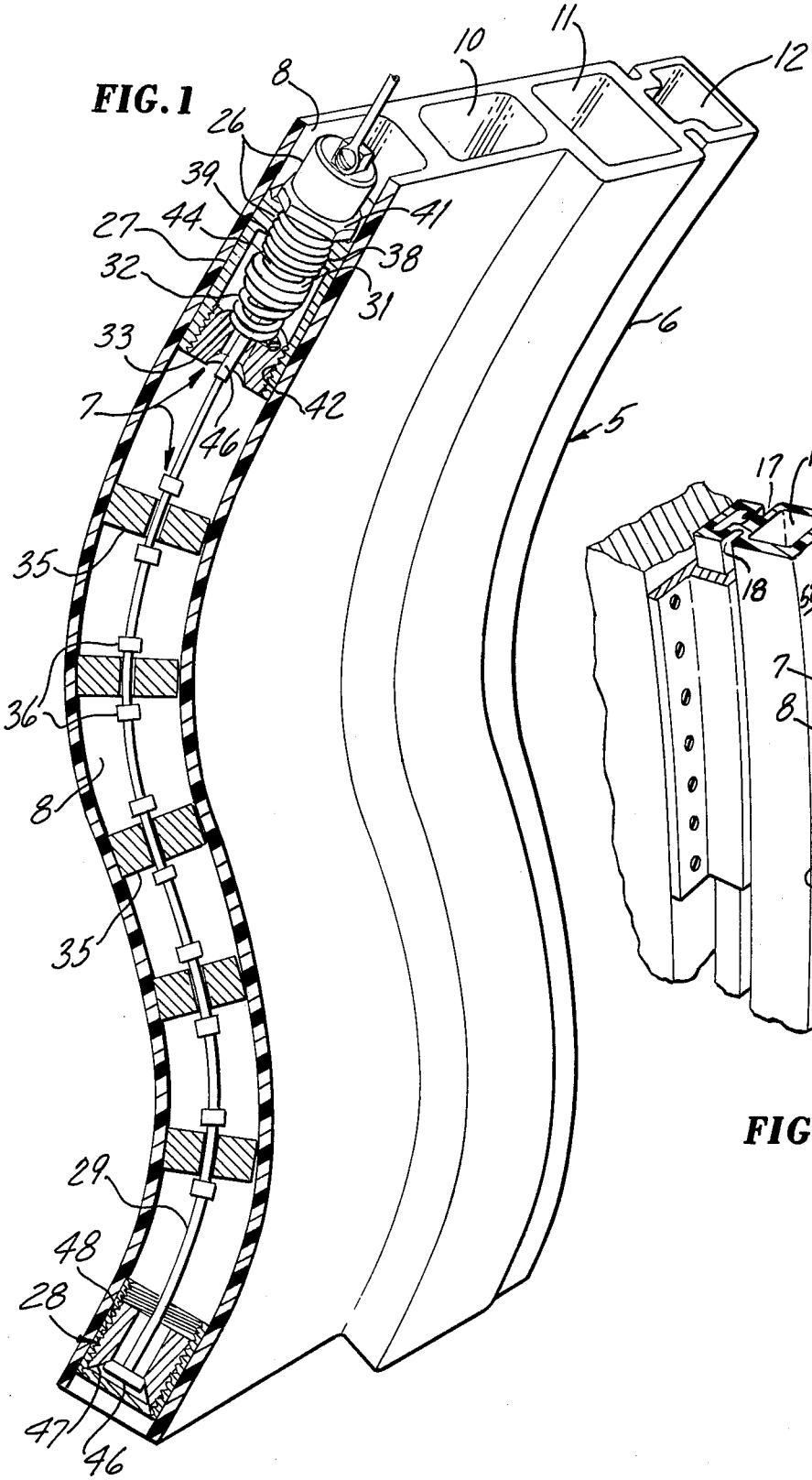
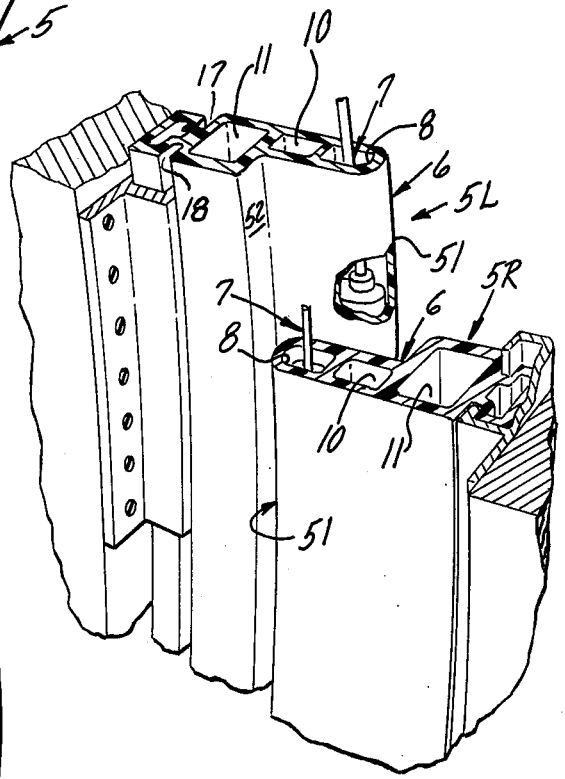
FIG. 2

TOUCH-SENSITIVE DOOR CONTROL SWITCH

BACKGROUND OF THE INVENTION

The prior art provides numerous devices for installation on the edges of doors of buses and other mass transit vehicles. In general, they are suitable for use only on straight-side vehicles which provide doors with rectilinear surfaces for attachment of a door control device. There is currently a trend in the designing of mass transit vehicles to form the bodies thereof with curved side surfaces and doors of conforming configuration. For example, the outer skin of the sides and doors of modern vehicles commonly have surfaces which are outwardly convexed, or even of S-shaped cross section in the vertical direction, with the result that prior art emergency touch-sensitive door-opening mechanisms are not satisfactory if indeed operative for this type of use.

Hence, it is an important object of the invention to provide emergency door-opening mechanism on doors of mass transit vehicles regardless of door configuration or curvature. Another object is to provide door-opening mechanism in accordance with the foregoing object having a switch and switch-actuating assembly which may be inexpensively manufactured and preassembled in a form that provides easy insertion as a unit into a flexible housing of the mechanism, convenient replacement, and ready adjustment from exteriorly of the housing for operation.

SUMMARY OF THE INVENTION

The invention resides in a touch-sensitive control device adapted for attachment to the edge of a vehicle door facing the path for passengers through an opening for which the door serves as a closure. The device comprises a resilient tubiform housing formed of a rubber or rubber-like composition having longitudinally extending distal and proximal end surfaces at the ends of its transverse cross section which normally extend the full length of a door with a corresponding proximal portion attached to a door edge by means which provide rigid continuous support along its full length. The housing has substantially greater width than thickness in a direction away from the door edge to render the outward distal portion of the housing flexible and warpable with respect to the rigidly supported proximal portion. Such flexibility of the distal portion about the proximal portion is also enhanced by an especially flexible intermediate portion of the housing. The distal portion is formed of a flexible wall which defines a longitudinal passageway.

The device further comprises an electrical switch and switch-operating assembly which is received in and extends usually the full length of the passageway. The assembly, as installed in the passageway, comprises a plurality of spacer blocks spaced at operating position generally uniformly along the passageway; a cable extending substantially the full length of the passageway centrally through the blocks; a normally resiliently closed switch comprising a body supported in one end of the passageway with an element thereof movable within the body to open and close an electrical circuit therethrough; anchor means fixed in the other end of the passageway to grip the cable; resilient and element-engaging means, such as a spring with a follower supported thereby against the element and connected with a portion of the cable adjacent to the switch.

The spring is seated in fixed relation with the passageway to act on the cable in the outward direction of the passageway toward the switch to place the cable in a condition of continuous tension in which the element is engaged and positioned to hold the switch open. As the result of proper location of the switch and the anchor means, the portion of the cable adjacent the switch and element-engaging means is positioned to maintain the switch in an open condition enabling it to close upon a predetermined deflection of the distal portion of the housing. Such deflection is accompanied by a corresponding shift in position of the portion of the cable extending from the deflected portion of the housing to the switch. The assembly can be adjusted to achieve closing by adjustable means incorporated either in the anchor means at one end of the housing or in the structure for supporting the switch at the other end of the housing. For this purpose, the anchor means or the support structure of the switch may comprise relatively rotatable components in threaded relationship.

BRIEF DESCRIPTION OF THE DRAWING

FIG. 1 is a fragmentary perspective view of the device of the invention with a distal wall section of the flexible housing of the device and a switch and switch operating assembly housed therein, shown in longitudinal cross section.

FIG. 2 is a perspective fragmentary view showing the adjacent edges of two doors equipped with touch-sensitive control devices according to the one shown in FIG. 1 with portions in overlapping relationship.

DESCRIPTION OF PREFERRED EMBODIMENTS

Figure 4:
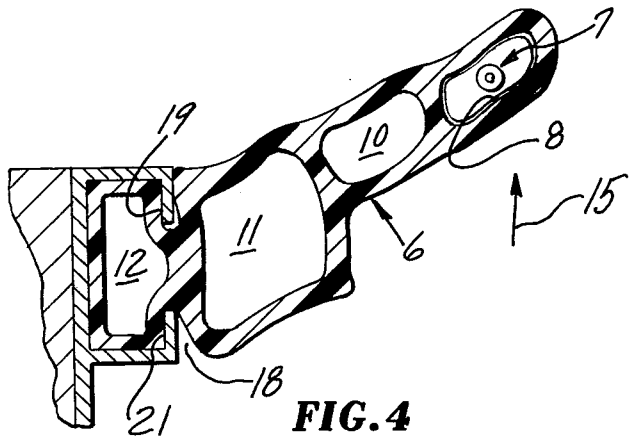
FIG. 4 is a view in transverse cross section of the device of FIGS. 1 to 3 shown warped in a counterclockwise direction about its proximal portion.

According to one embodiment of the invention as shown in FIGS. 1 and 2, a touch-sensitive control device 5, 5L or 5R comprises a tubiform housing 6 and an electrical switch and switch operating assembly 7 which includes a sleeve 27, a switch 28, cable 29 and other items detailed below received in a passageway 8 of the housing. The device 5 is shown in an S-shaped configuration of somewhat exaggerated curvature to illustrate that vehicles are now being designed which have an outer side contour of S cross section in a vertical plane.

Figure 3:
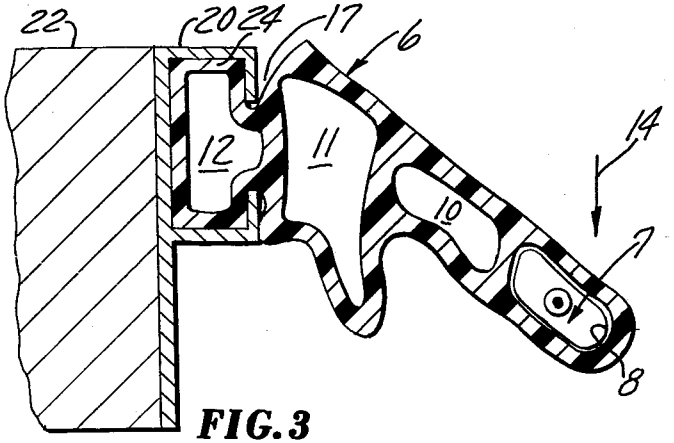
FIG. 3 is a view of the device of FIGS. 1 and 2 shown in transverse cross section in a deflected condition wherein it is warped in clockwise direction about a proximal portion.

The housing 6 is of known construction comprising a rubber or rubber-like material having, in addition to passageway 8, passageway 10, 11, and 12. The passageway 10 and 11 are sufficiently large to provide a wall weakening effect. The housing is shaped along a horizontal cross section with an enlarged intermediate portion extending the full length of the housing formed by the walls of the housing which surround the passageway 11. A proximal portion of the housing encloses the passageway 12. FIGS. 3 and 4 illustrate that the housing 6 is readily warpable when subjected to lateral forces in the direction of the arrows 14, 15. It may be noted tht the greatest deformation in the walls of the housing occur in a hollow intermediate portion of the housing 6, i.e., in those walls surrounding the passageway 11.

These walls are rendered more susceptible of deformation in response to lateral forces applied to distal areas of the housing, e.g., than to those walls surrounding the passageway 8, by the greater breadth and thickness of the intermediate section surrounding passageway 11, by the thinness of the walls around passageway 11, and by the presence of notches in the housing at 17 and 18 within which the inturned edges 19, 21 of the bracket 20 are received. Consequently, the more distal portion of the housing, identified by wall portions which encompass the passageways 10 and 8, fulcrum, in effect, in or adjacent the passageway 11 as the result of the larger size of the passageway 11 and the effective leverage of the distal portion on wider spanning, hence, easier deflected walls of the intermediate housing portion.

The housing 6 is secured to a door 22 by the bracket 20 which provides a C portion terminating in the edges 19, 21. The C portion of the bracket substantially encloses a proximal portion 24 of the housing. The bracket is constituted of metal or other rigid material which retains the proximal portion of the housing 6 in substantially rigid relation regardless of warping forces applied to the distal portion.

As an example of general dimensions of the housing and proportions thereof as shown in the drawing, the device 5 has been constructed in actual practice with a housing measuring $3\frac{1}{4}$ inches between its proximal and distal ends, $\frac{5}{8}$ of an inch crosswise of its distal portion, $1\frac{1}{4}$ inches across its intermediate portion surrounding passageway 11, 1 inch across the intermediate portion in its proximal-to-distal direction, $1\frac{5}{8}$ inches lengthwise of the narrow distal portion in the proximal-to-distal direction, with all walls being of approximately $\frac{1}{8}$ inch thickness. The passageway 8 was approximately $\frac{3}{8}$ inch by 11/16 inch.

Considering now a major feature of the invention, i.e., the construction of the switch and switch-operating assembly 7, the assembly as illustrated in FIG. 1 comprises a switch 26 and a switch-supporting sleeve 27 fixed within one end of passageway 8, an anchor 28 within the other end of passageway 8, a cable 29 extending between the anchor 28 and a switch actuating follower 31, a compression spring 32 housed by the sleeve 27 acting between the follower 31 and a plug 33 secured within the inner end of the sleeve 27, a plurality of spacer blocks 35 of conforming but slightly smaller contour than the inner surface of passageway 8 spaced substantially uniformly lengthwise thereof. As shown, the blocks 35 are spaced along the cable by being confined between a pair of cable clamps 36.

The switch 26 is preferably located in the upper end of the passageway 8 for greater freedom from moisture and dirt. It is supported to this location by a sleeve 27 secured to a fixed position within the passageway by means, such as an adhesive or the clamping arrangement described with respect to the second described embodiment below. The switch has a threaded portion 38 received in a threaded aperture 39 of the sleeve. Relative rotation of the switch in the sleeve is prevented by a lock nut 41 turned tightly against the top surface of the sleeve. The sleeve has a threaded internal surface 42 which receives the centrally apertured plug 33 which is adjusted inwardly of the surface 42 to put sufficient compressive force on the spring 32 in the follower 31 seated on the spring to engage and lift a spring-loaded plunger 44 of the switch 26 out of its normally circuit-closing position.

As shown, the follower 31 has a stem 46 into which the cable 29 extends and is secured.

Installation of the switch and switch-operating assembly 7 is achieved by preassembling the assembly exteriorly of the housing 6 and then lacing the assembly in a linear fashion through the passageway 8. Entry of the assembly into the passageway may be accomplished at either end but a practical procedure is to have the anchor 28 in place and fixed to the interior of the passageway 8, then with a lacing strand extending through the passageway attached to the lower end of the cable 29, draw the assembly into the top end of the passageway 8 and through the passageway until the cable 29 protrudes through the anchor 28 with the spring 32 compressed out of its normal state. Thereupon, a cable clamp 46 may be attached to the cable 29 to seat on the outer end surface of the plug 47 of the sleeve 48 of the anchor. As the plug and the sleeve are in threaded relationship, the plug may thereafter be turned to attain the proper tautness of the cable 29 and the proper position of the follower for holding the switch 26 open. The position of the follower 31 through linear adjustment of the cable should be such as to merely hold the switch out of closed condition so that, upon slight deformation of the distal portion of the housing 6, the increased tension in the cable would tend to bring about closing of the switch and the intended emergency retraction of the door 22.

FIG. 2 illustrates a type of door arrangement common in the construction of mass transit track or highway vehicles in which two doors are reciprocated toward and away from each other to close and open a vehicle doorway. In this arrangement, devices 5L and 5R are shown to have housing 6 which is normally cut from the same extrusion stock but may be mounted on a pair of separating doors of convex outward exterior with opposite curvatures to flexibly conform to the side curvature of a vehicle regardless of the side of the housing presented to the exterior of the vehicle. As a thickness of the housing 6 measured transversely through the aperture 10 is about $\frac{1}{2}$ of the thickness of the housing taken in a parallel direction through aperture 11, and the distal portion of the housing is offset with respect to the wider intermediate portion, the housing 6 of devices 5L and 5R are admirably suited to meet in overlapping relationship with the most distal surface 51 of one of the housings in adjacent relation with an interior angle surface 52 of the opposite housing. The ability of the housings 6 to conform either to concave or convex curvatures is illustrated also in FIG. 1.

Second Embodiment

Figure 5:
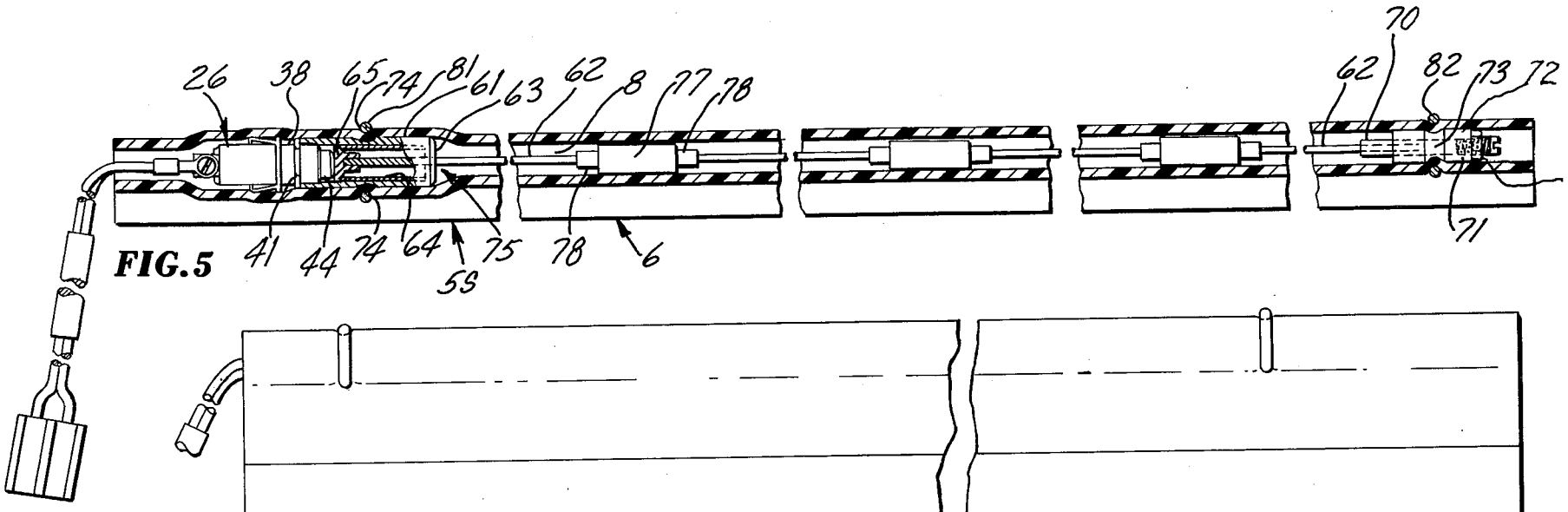
FIG. 5 is a fragmentary shortened end view of a touch-sensitive door-opening control device of modified construction showing in the foreground the distal portion of the device with wall sections broken away to expose switch and switch operating assembly shown in section.
Figure 6:
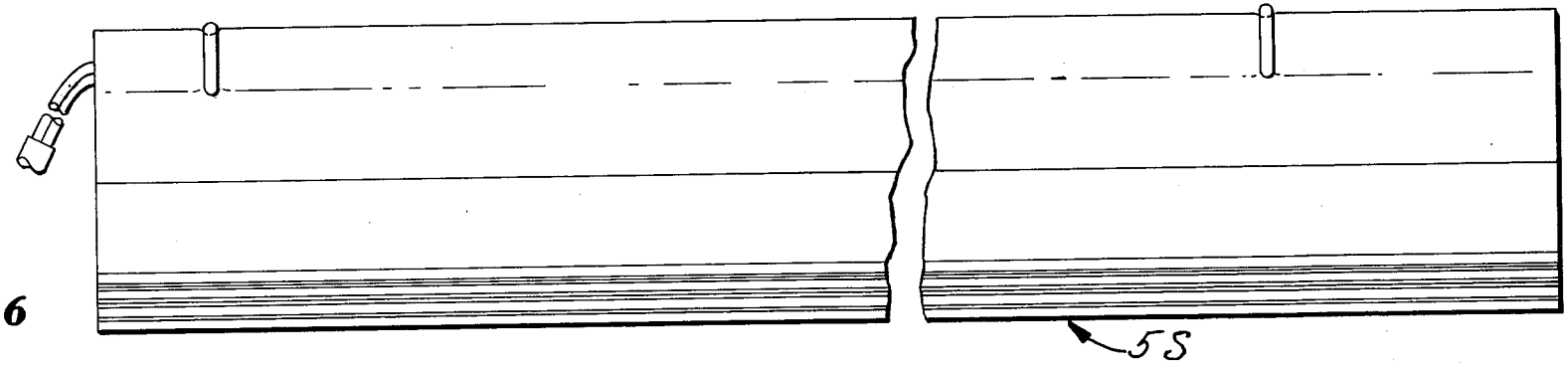
FIG. 6 is a shortened side view of the device shown in FIG. 5.

FIGS. 5 and 6 illustrate a device 5S that is similar to devices 5L and 5R except for details in the construction of the switch and switch-actuating assembly 75. In assembly 75 the threaded portion 38 of the switch extends in threaded relation into the interior surface of the wall of a sleeve 61 and is adjustable lengthwise of the sleeve by reason of this threaded relationship. The switch and the sleeve are made relatively nonrotatable by tightening of the nut 41 tightly against the end of the sleeve.

The lower end of the sleeve 61 is closed except for a central aperture for accommodating the cable 62 or a follower stem. The closed end wall 63 of the sleeve provides a seat for a spring 64 having an upward seat on a follower 65. The follower 65 is fixed to the upper end of the cable 62 and engages the plunger 44 of the switch to hold the switch out of circuit-closing condition when the switch is screwed inwardly of the sleeve to a proper position in correlation with a longitudinal adjustment of the cable within the anchor 71 to produce cable tautness.

The anchor 71 comprises a sleeve 72 having an external groove 73 and a threaded stem 70 secured to the cable 62 in threaded relation with the fastener or nut 83. Spacer blocks 77 are held in place by tubular elements 78 pinched into clamping relation with the cable. The blocks 77 are spaced uniformly within the passageway 8 of the housing 6. The blocks and the bushings are of outside dimensions which enable the assembly 75 to be drawn readily through the passageway 8 into the position shown in FIG. 5. The sleeve 61 is somewhat slightly larger than the sleeve 72 and its entry for short distance into the top of the passageway 8 may be facilitated by use of a lubricant. The assembly is secured into place by clamping rings 81, 82 which pinch the wall of the casing into conformity with the grooves 74, 73. Once the rings 81, 82 are in place, the stem 70 may be turned to a proper position relative to the sleeve to obtain a desired tautness in the cable 62 which allows closing of the switch as a distal portion of the housing 6 is warped through manual contact.

Although the structure has been described having a normally open switch that closes upon deformation of the housing, it will be apparent to those skilled in the art that with a different door-operating electrical-relay arrangement a normally closed switch that opens upon deformation of the housing can be substituted.

What is claimed is:

1. A touch-sensitive control device for mounting on a vehicle door comprising:

a resilient tubiform door-edge housing having longitudinally extending distal and proximal end surfaces at the ends of its transverse cross section and distal and proximal portions extending therealong of which the distal portion is flexible and warpable with respect to the proximal portion when the proximal portion is rigidly supported, said housing having a flexible wall defining its distal side which encloses a longitudinal passageway;

an electrical switch and switch-operating assembly received in said passageway comprising: a plurality of spacer blocks spaced at operating position generally uniformly along said passageway; a cable extending substantially the full length of the passageway centrally through said blocks; a normally resiliently closed switch comprising a body supported in one end of the passageway, and an element movable within the body between positions for opening and closing an electrical circuit therethrough; anchor means fixed in the other end of said passageway gripping said cable; resilient and element-engaging means connected with a portion of said cable adjacent to the switch acting on the housing in the outward direction of said one passageway end to place the cable in a condition of continuous tension and to engage said element, and to hold said switch in one of said positions; and adjustable means in said assembly for adjusting said switch body and cable toward and away from each other while maintaining said cable under tension at undeflected condition of said distal housing portion, said body and cable being adjustable to a relative position to maintain said switch in said one position enabling said switch to assume the other of said positions upon a predetermined deflection of said distal portion of the housing and a corresponding shift in position of said cable portion.

2. The control device for claim 1 comprising:

an interiorly threaded sleeve fixed within said one end of said passageway having spring seat means at the end of the sleeve more inward of said passageway;

said element being a plunger protruding from said body toward said spring seat means;

said resilient and element-engaging means comprising a follower attached to said cable within said sleeve normally in engagement with said plunger, said follower providing a spring seat facing said spring seat means; and a spring in a state of compression between said spring seat means and said spring seat;

said adjustable means comprising at least a portion of said body having an external thread in threaded relation with said sleeve, said body being rotatable within said sleeve toward and away from said follower.

3. The touch-sensitive control device of claim 1 comprising:

a first interiorly threaded sleeve fixed with said passageway to which said switch body is affixed;

an interiorly-threaded centrally-apertured plug in thread-meshing relation with the inner end portion of said sleeve;

a follower for engaging said element located within said sleeve between said element and said resilient means in engagement with body, said cable extending through said plug into attachment to said follower;

said anchor means comprising a second interiorly threaded sleeve fixed within said passageway and spaced therealong from said first sleeve, and an exteriorly threaded plug to which said cable is affixed in rotatable thread-meshing relation with said second sleeve to provide said adjustable means.

4. The touch-sensitive control device of claim 1 wherein:

said adjustable means resides at least partially in said anchor means and said anchor means comprises an interiorly threaded sleeve fixed within said other end of said passageway, and an exteriorly threaded plug to which said cable is affixed received within the thread in rotatable thread-meshing relation therewith.

5. The touch-sensitive control device of claim 1 wherein;

the perimetric surfaces of said spacer blocks are of conforming but of slightly smaller contour than the transverse cross section of said passageway; and said cable and said spacers are portions of a preassembled assembly comprising cable clamps spaced along said cable to position the spacer block relative to the cable length enabling one end of said assembly to be inserted into said passageway and the entire assembly progressively pulled thereinto into operable position.

6. The touch-sensitive control device of claim 1 comprising:

a pair of sleeves conforming to the inner surface of said passageway of which one is a portion of said anchor means and the other is means for supporting said switch, said sleeves having external circumferential grooves located intermediately of respective lengths; and clamp means slidable over said housing in registry with the grooves to secure the sleeves within the housing.

7. The touch-sensitive control device of claim 1 wherein:

said housing has wall-weakening passageways between said distal and proximal portions enhancing deflection or warping of engaged distal areas toward said proximal portion.

8. A sensitive-control device of claim 1 wherein:

the width of a transverse cross section of the housing extends between said proximal and said distal end surfaces, and the thickness of said cross section extends transversely of said width; and the housing comprises said proximal portion in a form adapted to be gripped by a rigid supporting means, said distal portion houses said assembly, and an intermediate portion between said other two portions is substantially wider than said distal portion and substantially open by a longitudinal passageway therethrough to render the walls of the intermediate section sufficiently flexible and deformable to enable warping of said housing with said distal portion moving about an approximate fulcrum located in or adjacent said intermediate housing portion.

* * * * *